United States Patent [19]

Maller

[11] 4,131,289

[45] Dec. 26, 1978

[54] SKI EQUIPMENT CARRIER

[76] Inventor: Karen Maller, 265-24 74th Ave., Glen Oaks, N.Y. 11004

[21] Appl. No.: 717,068

[22] Filed: Aug. 24, 1976

[51] Int. Cl.[2] ..... A63C 11/10

[52] U.S. Cl. ..... 280/11.37 K; 224/8 R; 224/5 Z; 224/45 S; 150/52 R

[58] Field of Search ..... 224/45 S, 45 R, 5 Z, 224/5 R; 280/11.37 R, 11.37 K, 11.37 A; 211/605 K; 150/52 R

[56] References Cited

U.S. PATENT DOCUMENTS

| | | | |
|---|---|---|---|
| 23,582 | 4/1859 | Johns | 224/10 |
| 1,031,361 | 7/1912 | Mitchell | 150/52 R |
| 2,224,568 | 12/1940 | Altorfer | 224/5 Z |
| 2,565,680 | 8/1951 | Feld | 150/52 R X |
| 2,693,259 | 11/1954 | Amick | 150/52 R X |
| 3,851,689 | 12/1974 | Kohls | 280/11.37 K X |
| 3,921,871 | 11/1975 | Heil | 224/45 S |

FOREIGN PATENT DOCUMENTS

| | | | |
|---|---|---|---|
| 1299186 | 6/1962 | France | 280/11.37 R |
| 1552202 | 11/1968 | France | 280/11.37 K |
| 287771 | 8/1931 | Italy | 224/5 Z |

*Primary Examiner*—Albert J. Makay
*Assistant Examiner*—Donald W. Underwood
*Attorney, Agent, or Firm*—Martin P. Michael

[57] ABSTRACT

A ski equipment carrier is constructed of a bag-like container mounted on a base which permits transport across both bare and snow covered surfaces. The container and base may be opened such that access to the interior of the container which holds the ski equipment securely is possible and such that when in a fully open position the bag and its contents may be held securely by a conventional automobile ski rack. A handle means is connected to the carrier such that when the carrier is in the fastened upright position the handle means allows the carrier to be easily transported by the skier. In addition, the carrier can be adapted to be conveniently carried by the skier while skiing or stored in a small locker. The carrier thereby enables skiers to more easily and safely transport ski equipment to and from home, the car, the ski slopes and affords substantial protection to the equipment during such transport.

9 Claims, 6 Drawing Figures

10
11
12
13
14
15
16
17
19
20
21
22
23
24
25

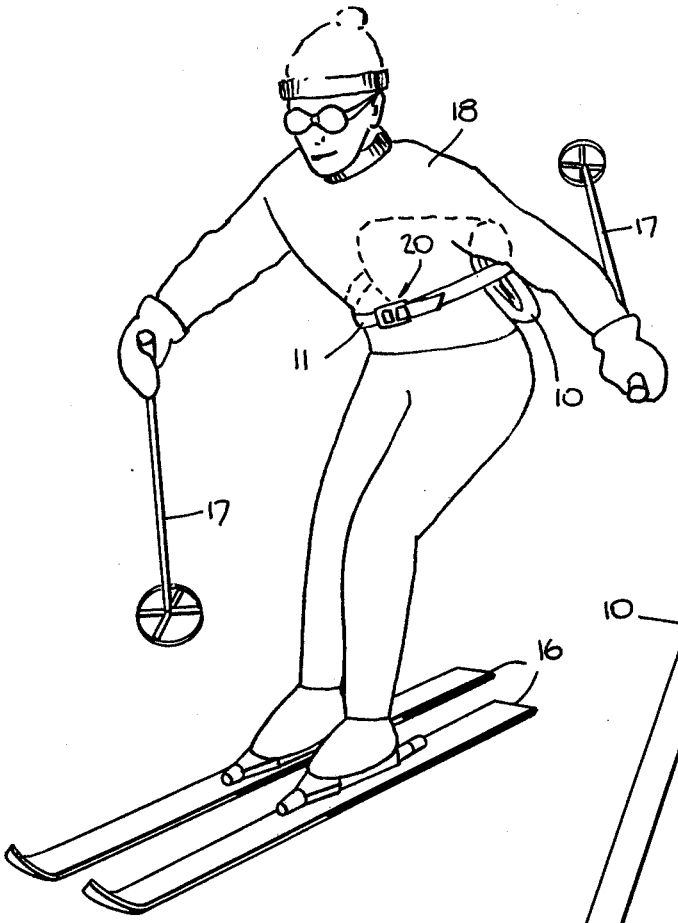
Fig. 6.
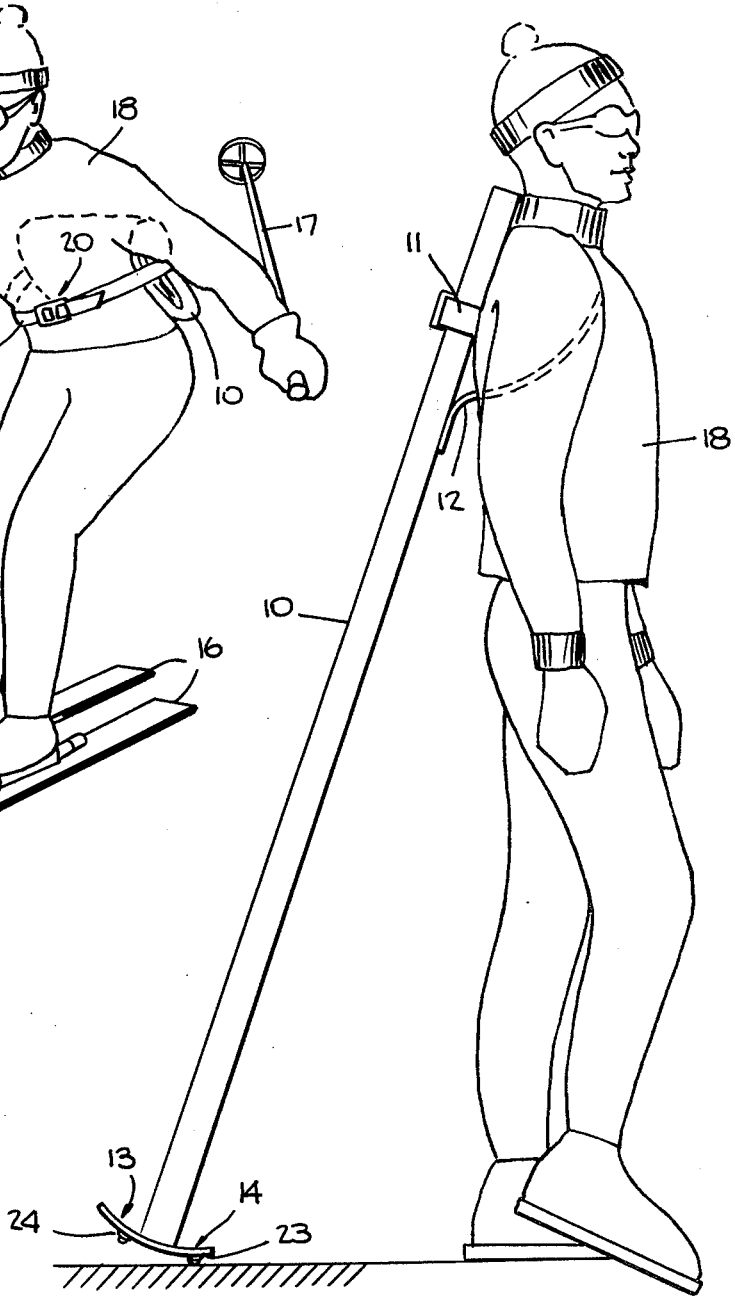
Fig. 4.
Fig. 5.
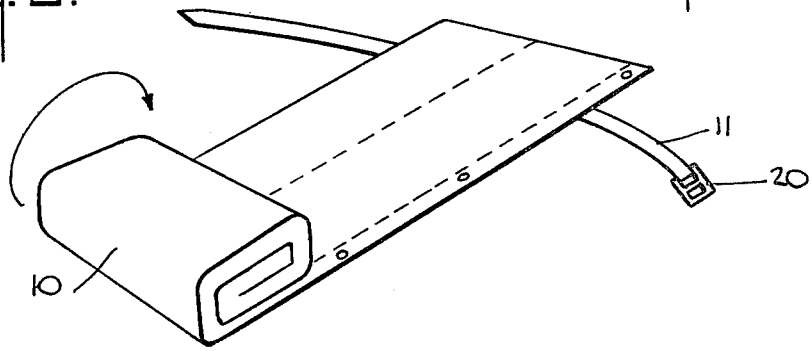

SKI EQUIPMENT CARRIER

BACKGROUND AND PRIOR ART

This invention relates to a new ski equipment carrier which solves many of the problems of transporting ski equipment which have plagued skiers for years.

Because skis, ski poles and ski boots are heavy, bulky and difficult to carry and because most skiers live far from the ski slopes themselves, skiers have long sought a convenient and relatively inexpensive way to transport their equipment from home to the ski slopes and back again.

Travel to and from the slopes involves carrying the equipment over varying terrain and surfaces. This travel usually includes transport over paved surfaces such as sidewalks and snow covered surfaces such as ski slopes as well as transporting the equipment by automobile using a typical ski rack apparatus.

It should also be noted that parking facilities for most ski areas are usually located substantial distances from the ski slope itself, thereby requiring the skier to carry his equipment over these distances which often involves travel over parking lots and other surfaces some of which are bare and some of which are snow covered.

As a result any device which would be of substantial help in solving these transportation problems would have to be light, compact and operate well on both bare and snow covered surfaces and be readily adaptable for use in conjunction with an automobile ski rack.

Moreover, because of the great and still burgeoning popularity of skiing today, most ski resorts are crowded and have little or no room for safe storage of a large or bulky ski equipment carrier. These circumstances further require that a practical ski equipment carrier be so designed that it may be conveniently carried by the skier while skiing.

Finally, although ski equipment is built to take the punishment of skiing, it is not as well suited for transportation. Therefore, a properly designed ski equipment carrier should also provide maximum protection for the ski equipment during transportation.

The prior art reveals certain attempts to meet some of these needs, however, none of them can offer the advantages of the instant invention nor are they as versatile and adaptable as the instant invention.

The prior art found is disclosed in U.S. Pat. 2,224,568 (Altorfer), U.S. Pat. No. 3,504,921 (Osmond) and U.S. Pat. No. 3,779,568 (Wakabayashi). The designs of the Altorfer, Osmond and Wakabayashi devices are obviously far different than the instant invention and neither fulfills the skier's transportation needs as well or as completely as the instant invention.

None of the prior art devices provide protection for the ski equipment during transport, thereby unnecessarily subjecting the bindings to corrosion and damage. Moreover, the prior art devices are not compatible with existing ski racks and are not readily adaptable to carry boots or other equipment.

In addition, the Osmond device is both heavy and bulky. Because of its weight and bulk, it cannot be conveniently carried with the skier while skiing, thereby requiring storage facilities at the ski area. Even if such facilities are available, the carrying apparatus would be subject to damage and possible theft while the owner is skiing.

SUMMARY OF THE INVENTION

The instant invention provides skiers with an efficient, convenient and relatively inexpensive means for transporting their ski equipment both to and from the ski slopes and at the same time offering protection to the equipment itself and enhancing skier's safety both on and off the slopes.

The ski equipment carrier contemplated hereunder is constructed of a bag-like container member made of a suitable durable, yet lightweight and pliable material such as canvas or vinyl, mounted, by suitable conventional means, upon skid-like base member made of a sturdy material such as hardened rubber, aluminum, or plastic. The carrier is so constructed that the container member may be opened allowing complete access to the interior of the container member and allowing the container member to open flat so that the carrier and the ski equipment it contains may be securely placed in a conventional automobile ski rack.

The base member is equipped with a conventional freely rotating ball-like means, extending slightly below the underside of the base member thereby enabling the carrier to be rolled over hard or bare surfaces, e.g., paved sidewalks with a high coefficient of friction by engaging the rotating ball-like means and to be slid over softer or snow covered surfaces with a lower coefficient of friction by engaging the bottom surface of the base member.

The interior of the container member can be comprised of pocket-like compartments open at the top so that skis and ski poles are easily inserted and removed to and from the compartments when the container member is in the open position and are held secure in the container member when in the closed position.

A means can be attached to the carrier such that when the carrier is in the closed upright position, the means may be placed around the skier's shoulder allowing the carrier to be easily pulled along behind the skier thus leaving the hands of the skier free for improved balance and safety.

The carrier can be provided with a means so that when the ski equipment is removed from the container member, the carrier may be folded around the base member and secured in that folded position and secured around the waist of the skier.

In a preferred embodiment of the invention the bag-like container member is made of one exterior layer of a heavy-duty but pliable canvas with the pocket-like compartments being made by sewing an interior layer of canvas to the exterior layer so that compartments suitable to hold skis and ski poles are made by the seams. A flap is attached to the exterior layer of the container member such that it can be folded over the open ends of the compartments and fastened closed with conventional snaps thereby providing for further protection of the equipment during transportation. The flap is easily unsnapped to allow ready access to the skis and poles in the compartments. A strap is affixed in two places to the exterior of the container member so that the strap may be placed around the skier's shoulder allowing the carrier to be easily pulled along behind without requiring the skier's hands to pull or guide the carrier. A conventional belt and buckle assembly are attached to the exterior of the container member near its upper end such that when the container is closed the belt may be wrapped around the container member and buckled for added fastening security and such that when the ski equipment is removed from the container member and the container member is folded around the base member into a compact package, the carrier can be secured simultaneously around the waist of the skier and in the folded position. The container member, which can be opened on three sides, may be securely fastened closed by a plurality of conventional snaps located around the edges of the three sides. The base member is divided into two approximately semi-oval parts which parts are connected with a hinge. Each part is attached to the container member such that when the carrier is in the closed position the straight edges of the parts of the base member fit flush together to form an approximately oval skidlike device. When the container member is in the open position the parts open about the hinge to allow the carrier to open flat for compatibility with a conventional automobile ski rack. The base member is slightly bowed and is equipped with two conventional freely rotating ball rollers of the type commonly found on the bottom of luggage. The rollers are connected to a forward part of the base member and extend slightly below the underside of the base member such that the carrier can be rolled over bare surfaces and slid over snow covered surfaces when the carrier is being pulled by the skier. The rear part of the base member has a small projection protruding from the underside of the base member such that the carrier when containing ski equipment can stand alone in a vertical position by resting on the two rollers and the protection and such that when the carrier is tilted forward to be pulled the protection is no longer in contact with the ground and does not interfere with the movement of the carrier.

Another embodiment of the invention comprises: a container member adapted to open and close to expose the inner surfaces thereof; a pocket means integral with the interior surfaces of said container member adapted to receive ski equipment and hold said equipment within said container member; a base member integral with one end of said container member and hingedly adapted to open and close with said container member; handle means affixed to said container member to enable said container member to be transported when in a closed position; and a skid means affixed to said base member adapted to engage a bare or snow covered ground surface and to permit the apparatus to be transported along said ground surface. The aforementioned skid means may comprise a freely rotating ball roller extending below the underside of the base member such that the apparatus can be rolled over bare surfaces by engaging the roller and slid over snow covered surfaces by engaging the underside of the base member. The aforementioned handle means may comprise a strap affixed to the apparatus such that it may be placed around the skier's shoulder allowing the apparatus to be transported without requiring the use of the skier's hands or arms. In addition, a belt may be attached to the container member such that when the container member is closed the belt may be wrapped around the container member to insure that the container member remains closed and such that when the ski equipment is removed, the container member may be folded around the base member into a compact form and the apparatus can be secured around the waist of the skier and in the compact form.

Another embodiment of the invention comprises: a substantially hollow container member; said container member having a pocket means integral with the inner surface of said container member and being adapted to receive and maintain ski equipment within said container member; a base member integral with one end of said container member; a handle means affixed to said container member to enable said container member to be transported; and a skid means affixed to said base member adapted to engage a bare or snow covered ground surface and to permit the apparatus to be transported along said ground surface.

Another embodiment of the invention comprises: a container member adapted to open and close to expose the inner surfaces thereof; a fastening means integral with said container member to secure the container member in the closed position; a plurality of open-ended pocket means integral with the interior surfaces of said container member adapted to completely receive and envelop said ski equipment and hold said equipment in a relatively fixed position within said container member; a flap connected to said container member adapted to fold over the open ends of said pocket means to further envelop and hold said ski equipment within said container, said flap having a second fastening means to hold the flap over the open ends of said pocket means; a base member integral with one end of said container member and hingedly adapted to open and close with said container; a strap affixed to the apparatus such that it may be placed around the skier's shoulder allowing the apparatus to be transported without requiring the use of the skier's hands or arms; a skid means affixed to said base member adapted to engage a bare or snow covered ground surface and to permit the apparatus to be transported along said ground surface; and a belt attached to the container member such that when the container member is closed the belt may be wrapped around the container member to insure that the container member remains closed and such that when the ski equipment is removed, the container may be folded around the base member into a compact form and the apparatus can be secured around the waist of the skier and in the compact form. The aforementioned base member may be bowed and the aforementioned skid means may comprise two freely rotating ball rollers and a projection connected to the base member such that the apparatus when containing ski equipment can stand alone in a vertical position by resting on the two rollers and the projection and such that when the apparatus is tilted forward to be transported by the skier the projection no longer engages the ground and the apparatus is permitted to be transported over a bare or snow covered surface.

Another embodiment of the invention comprises a container member adapted to accomodate ski equipment; a base member connected to said container member and adapted to support the container member; said base member having a skid means enabling the apparatus to be transported over both bare and snow covered surfaces.

Another embodiment of the invention includes pouches for carrying ski boots attached to the exterior of the carrier.

Another embodiment includes a cushioning layer between the base member and the container member to add additional protection for the skis.

Another embodiment can include a pleated container member to ease folding of the container member around the base member.

It is readily apparent that the instant invention has many advantages over the prior art. It is convenient, inexpensive and easily made. It fulfills the needs of the skiers as described above far better than anything in the prior art.

BRIEF DESCRIPTION OF THE DRAWINGS

FIG. 4 illustrates a side view of an embodiment of the invention in the closed position being pulled along by a skier.

FIG. 5 illustrates an embodiment of the invention being folded around the base into a compact package.

FIG. 6 illustrates an embodiment of the invention secured in the folded position and around the skier's waist while skiing.

DETAILED DESCRIPTION OF THE DRAWINGS

Figures 1, 2, 3:
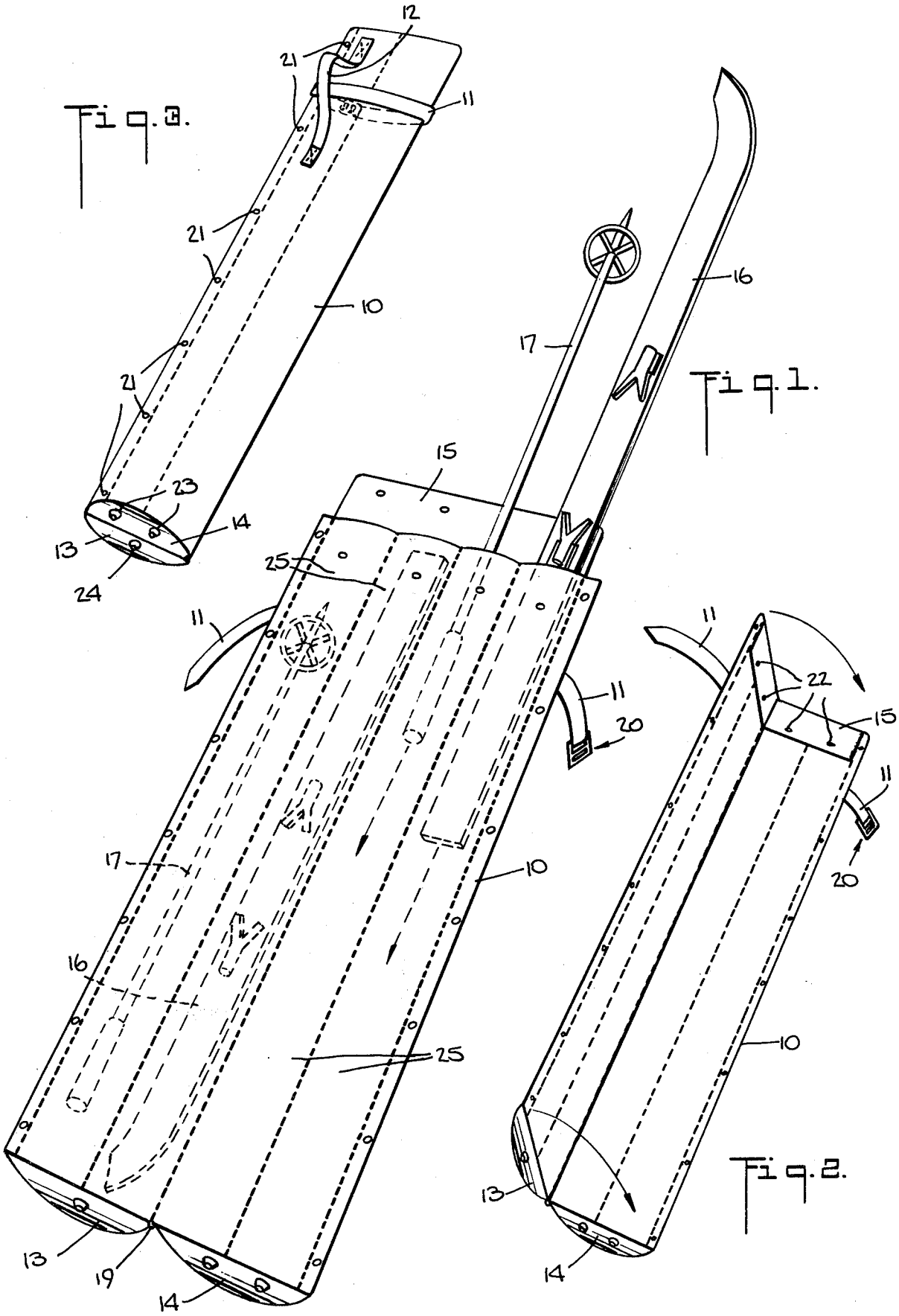
FIG. 1 illustrates a perspective view of an embodiment of the invention in the open position.
FIG. 2 illustrates a perspective view of an embodiment of the invention in the open position and showing how the carrier is closed.
FIG. 3 illustrates a perspective view of an embodiment of the invention in the closed position.

FIG. 1 illustrates a perspective view of an embodiment of the ski equipment carrier in the open position showing how the skis 16 and ski poles 17 can easily be inserted and removed from the open-topped pocket-like compartments 25 of the interior of the container 10. As can be seen in FIGS. 1 and 2, the container 10 is so mounted on a two-part base 13 and 14 which parts are pivotally connected by hinge 19 in a manner enabling the carrier to be easily opened and closed. A flap 15 is folded over the open tops of the compartments 25 and secured down by snaps 22 to give added protection to the ski equipment during transport. In the fully open position as shown in FIG. 1, the carrier is compatible with most conventional automobile ski racks.

FIG. 3 illustrates an embodiment of the carrier in the closed position showing the snaps 21 and a belt 11 and buckle 20 used to fasten the carrier in the closed position. As can be seen by comparing FIGS. 2 and 3 each part of the two part base 13 and 14 is in semi-oval configuration connected by a hinge 19 and is attached to the container 10 such that when the carrier is in the closed position the straight edges of the parts of the base 13 and 14 fit flush together to form an approximately oval skid-like device.

FIGS. 3 and 4 illustrate how, an embodiment of the carrier in the closed position, can be pulled along behind the skier 18 by placing a strap 12 which is affixed to the exterior of the container 10 around the skier's 18 shoulder and thereby keeping the hands and arms of the skier 18 free for improved balance and safety.

FIGS. 3 and 4 also illustrate the two parts of the base 13 and 14 in the closed position. As shown, the forward part of the base 14 is equipped with two conventional freely rotating ball rollers 23 which extend below the underside of the forward parts of the base 14 such that the carrier can be rolled over bare surfaces by engaging the rollers 23 and slid over snow covered surfaces by engaging the underside of the forward part of the base 14 as the carrier is being pulled by the skier as shown in FIG. 4. FIGS. 3 and 4 also show the rear part of the base 13 has a small projection 24 protruding from the underside of the rear part of the base 13 such that the carrier can stand alone in a vertical position by resting on the two rollers 23 and the projection 24 and such that when the carrier is tilted forward to be transported as shown in FIG. 4 the projection 24 is no longer in contact with the ground and does not interfere with the movement of the carrier over the ground.

FIGS. 5 and 6 illustrate how, in an embodiment of the invention, the container 10, when the skis and poles 16 and 17 are removed, may be folded around the two parts of the base 13 and 14 into a compact package and how the belt 11 and buckle 20 can be used to simultaneously secure the carrier around the waist of the skier 18 and in that compact package so that the carrier can be kept with the skier 18 while skiing.

Although specific embodiments of the invention have been illustrated and described, it will be obvious to those skilled in the art that various modifications may be made without departing from the spirit of the invention which is intended to be limited solely by the appended claims.

What is claimed is:

1. An apparatus for carrying ski equipment, said ski equipment comprised of one or more skis and/or ski poles, comprising:

(a) a container member having inner and outer surfaces and adapted to open and close to expose the inner surfaces thereof said container member being foldable into compact form when the ski equipment is removed therefrom;

(b) a plurality of open ended pocket means integral with the inner surfaces of said container member adapted to completely receive and envelop said ski equipment and hold said equipment in a relatively fixed position within said container member;

(c) a bowed base member integral with one end of said container member and hingedly adapted to open and close with said container member;

(d) a strap affixed to the apparatus such that it may be placed around the skier's shoulder allowing the apparatus to be transported without requiring the use of the skier's hands or arms;

(e) skid means affixed to said base member comprising two freely rotating ball-like rollers and a projection connected to the base member such that the apparatus when containing the ski equipment can stand alone in a vertical position by resting on the rollers and the projection and such that when the apparatus is tilted forward to be transported by the skier the projection no longer engages the ground and the apparatus is permitted to be transported over a bare surface on the rollers and over snow covered surfaces on the bottom surface of the base member; and (f) a belt attached to the container member such that when the container member is closed the belt may be wrapped around the container member to insure that the container member remains closed and such that when the ski equipment is removed the container member may be folded around the base member into a compact form and the apparatus can be secured around the waist of the skier in compact form.

2. An apparatus for carrying ski equipment comprised of one or more skis and/or ski poles, comprising:

(a) a container member having inner and outer surfaces and adapted to open and close to expose the inner surfaces thereof;

(b) a fastening means integral with said container member to secure the container member in the closed position;

(c) a plurality of open ended pocket means integral with the inner surfaces of said container member adapted to completely receive and envelop said ski equipment and hold said equipment in a relatively fixed position within said container member;

(d) a flap connected to said container member adapted to fold over the open ends of said pocket means to further envelop and hold said ski equipment within said container, said flap having a second fastening means to secure the flap over the open ends of said pocket means;

(e) a base member integral with one end of said container member and hingedly adapted to open and close with said container member;

(f) a strap affixed to the apparatus such that it may be placed around the skier's shoulder allowing the apparatus to be transported without requiring the use of the skier's hands or arms;

(g) skid means affixed to said base member, said skid means comprising two freely rotating ball rollers and a projection connected to the base member such that the apparatus when containing the ski equipment can stand alone in a vertical position resting on the rollers and the projection and such that when the apparatus is tilted forward to be transported by the skier the projection no longer engages the ground and the apparatus is permitted to be transported over bare surfaces on the rollers and snow covered surfaces on the bottom surface of the base member; and (h) a belt attached to the container member such that when the container member is closed the belt may be wrapped around the container member to insure that the container member remains closed and such that when the ski equipment is removed the container member may be folded around the base member into a compact form and the apparatus can be secured around the waist of the skier and in the compact form.

3. An apparatus for carrying ski equipment over both bare and snow covered surfaces, comprising:

(a) a container member adapted to accommodate ski equipment comprised of one or more skis and/or ski poles;

(b) a base member integral with one end of said container member; and (c) skid means affixed to said base member comprising freely rotating ball-like rollers and a projection connected to the base member such that the apparatus when containing the ski equipment can stand alone in a vertical position by resting on the rollers and the projection and such that when the apparatus is tilted forward to be transported by the skier the projection no longer engages the ground and the apparatus is permitted to be transported over bare surfaces on the rollers and over snow covered surfaces on the bottom surface of the base member.

4. An apparatus for carrying ski equipment, comprising:

(a) a container member adapted to substantially fully accommodate ski equipment comprised of one or more skis and/or ski poles, said container member having inner and outer surfaces and being foldable into compact form when the ski equipment is removed therefrom;

(b) a base member integral with one end of said container member; and (c) skid means affixed to said base member wherein said base member is bowed and wherein skid means comprises freely rotating ball-like rollers and a projection connected to the base member such that the apparatus when containing the ski equipment can stand alone in a vertical position by resting on the rollers and the projection and such that when the apparatus is tilted forward to be transported by the skier the projection no longer engages the ground and the apparatus is permitted to be transported over a bare surface on the rollers and snow covered surfaces on the bottom surface of the base member.

5. The apparatus of claim 4 further comprised of a handle means affixed to the container member, said handle means comprising a strap affixed to the apparatus such that it may be placed around the skier's shoulder allowing the apparatus to be transported without requiring the use of the skier's hands or arms.

6. The apparatus of claim 4 further comprised of a belt means attached to the container member such that when the ski equipment is removed, the container member may be folded around the base member into a compact form and the belt means can secure the apparatus around the waist of the skier in compact form.

7. The apparatus of claim 4 wherein said container member is adapted to open and close to expose the inner surfaces thereof.

8. The apparatus of claim 7 wherein said base member is hingedly adapted to open and close with said container member.

9. The apparatus of claim 4 further comprised of a pocket means integral with the inner surfaces of said container member adapted to receive the ski equipment within said container member.

* * * * *